US005421136A

United States Patent [19]

Van De Peer

[11] Patent Number: 5,421,136

[45] Date of Patent: Jun. 6, 1995

[54] FOUNDATION CONSTRUCTION

[75] Inventor: Christopher Van De Peer, Seven Hills, Australia

[73] Assignee: Fiberslab Pty Limited, Seven Hills, Australia

[21] Appl. No.: 127,527

[22] Filed: Sep. 28, 1993

[30] Foreign Application Priority Data

Oct. 1, 1992 [AU] Australia ..... 26147/92
Oct. 1, 1992 [AU] Australia ..... 26148/92

[51] Int. Cl.[6] ..... F02D 27/08; E04C 5/16; F04G 21/12

[52] U.S. Cl. ..... 52/294; 52/677; 52/687; 52/741.1

[58] Field of Search ..... 52/677, 687, 688, 689, 52/294, 743, 741.1

[56] References Cited

U.S. PATENT DOCUMENTS 1,353,373 9/1920 Allbright ..... 52/677
3,378,981 4/1968 Horne ..... 52/677
4,788,809 12/1988 Koukourou ..... 52/677
4,831,803 5/1989 Leonardis ..... 52/687

FOREIGN PATENT DOCUMENTS 562334 6/1987 Australia .
584769 6/1989 Australia .
591816 12/1989 Australia .

*Primary Examiner*—Michael Safavi

[57] ABSTRACT

A building foundation includes a plurality of foundation elements (3, 212), spaced apart from one another to form a plurality of elongate channels (4) therebetween. A plurality of base reinforcing supports (10, 118) for base reinforcing material are provided within the channels (4) between the foundation elements (3, 212). Upper supports (15, 111) are supported on upper side edge surfaces of the foundation elements (3) so as to extend within upper areas of the channels (4) to allow for support of upper reinforcing material above the base supports (10, 218) and base reinforcing material and extending between spaced apart foundation elements (3, 212). Concrete is poured over the foundation elements (3, 212), the base spacers (10, 218), the upper supports (15, 111) and the reinforcing material, within a predetermined area.

9 Claims, 8 Drawing Sheets

FOUNDATION CONSTRUCTION

BACKGROUND OF THE PRESENT INVENTION

This invention relates to the construction of concrete foundations for buildings and the like.

The formation of concrete foundations for buildings is well known. Various attempts have been made to provide various forms of building foundations and methods of forming building foundations.

One form of building foundation that has been used is a building foundation provided within an outer formwork, which involves the use of a plurality of spaced apart building elements or blocks which are spaced apart within the area bounded by the formwork, so as to provide a plurality of channels between the adjacent, spaced apart elements, for example intersecting channels which are often substantially at right-angles one with the other. It is known to provide spacers between the elements and in particular it is known to provide spacers at corners between the elements. Elongate reinforcing material then extends within the channels between the building elements and over the spacers, so as to be located between the elements, on the spacers, but above the ground surface. For example, such arrangements are known from Australian patent specifications Nos 562334, 584769 and 591816.

In Australian patent specifications Nos 562334 and 591816, there is disclosed a foundation arrangement and method of forming a foundation arrangement involving the use of cardboard box elements with spacer means provided at each corner, to separate the elements and so as to form channels therebetween. A similar arrangement is also disclosed in Australian patent specification No 584769.

In the building foundations used and known up until this time, and which use such spaced apart elements, a mesh of reinforcing is provided over the top of the elements before concrete is poured over the reinforcing, the elements and the mesh, within the periphery of the foundation being formed and as defined by outer formwork. This is disclosed in each of the above Australian patent specifications Nos 562334, 584769 and 591816. Further, the methods and arrangements used up until this time, and as exemplified in the above Australian patent specifications, involve the placing of reinforcing spacers on the top of the elements so as to support the mesh extending over the top of the elements.

Such arrangements have been found to have substantial disadvantages.

Firstly, in cases where hollow cardboard boxes or substantially hollow elements are used in foundation constructions, it is often necessary to place pressure on the upper surfaces of the elements during placement and location of the reinforcing mesh which extends over the upper surfaces of the elements. This can damage the elements. In addition, such elements can be affected by rain and the like and this particularly applies to cardboard spacing elements, which can be affected not only by rain, but also by pressure being applied to upper surfaces thereof. If this happens while reinforcing mesh is mounted on and over the upper surfaces of such elements, the reinforcing mesh can be moved or tilted out of position. This is particularly unsatisfactory from the point of view of providing satisfactory foundation constructions.

Further, the use of reinforcing mesh extending over the upper surfaces of the elements involves a substantial amount of reinforcing material such as steel reinforcing material. This is particularly expensive.

In arrangements known up until this time various forms of spacing elements have been used for spacing and locating reinforcing material (such as rods of metal reinforcing material) between and relative to foundation elements used in the building of foundation construction. Such spacing elements have not always been completely successful however.

The present invention sets out to provide an arrangement and method whereby one or more of these problems are overcome or at least substantially minimised.

It is a further object of this invention to provide straightforward and efficient spacing elements for use in foundation construction.

Other objects of this invention will become apparent from the following description.

SUMMARY OF THE PRESENT INVENTION

According to one aspect of this invention, there is provided a building foundation including a plurality of foundation elements located on a base surface, and spaced apart one from the other within a predetermined area, such as to form a plurality of elongate channels extending between said elements; a plurality of base reinforcing support spacers being located on said base surface and within said channels between adjacent elements, reinforcing extending relative to said base spacers within said channels; a plurality of upper reinforcing supports being provided and each having a body portion defining one or more recesses to locate upper reinforcing; each upper support being supported on and extending between upper side edge surfaces of spaced apart foundation elements on opposing sides of a channel, so that the body portion of each upper support is located within an upper area of a channel, spaced apart from and above said base spacers; reinforcing being located on and between spaced apart upper supports so as to extend over and above the base spacers and base reinforcing and including concrete poured within the predetermined area, so as to envelop said foundation elements, said base spacers, said upper supports and said reinforcing.

According to a further aspect of this invention, there is provided a building foundation including a plurality of foundation elements spaced apart one from the other on a base surface within a predetermined area bounded by outer formwork, such as to form a plurality of elongate channels extending between said elements; a plurality of base reinforcing support spacers being located on said base surface, within said channels and between opposing sides of spaced apart adjacent foundation elements; reinforcing extending relative to said base spacers within said channels; a plurality of upper reinforcing supports being provided and each having a body portion defining one or more recesses to locate reinforcing; each upper support being supported on and extending between upper side edge surfaces of spaced apart foundation elements on opposing sides of a channel, so that the body portion of each upper support is located within an upper area of a channel, spaced apart from and above said base spacers; reinforcing being located on and between spaced apart upper supports so as to extend over and above the base spacers and base reinforcing and including fiber-reinforced concrete poured within the area bounded by said formwork, so as to envelop said foundation elements, said base spacers, said upper supports and said reinforcing.

According to a further aspect of this invention, there is provided a method of forming a building foundation, including locating a plurality of foundation elements on a base surface, within a predetermined area, such that the foundation elements are spaced apart one from the other so as to form a plurality of elongate channels therebetween; locating a plurality of base spacers on said base surface and within said channels between adjacent foundation elements; placing elongate reinforcing over/on said base spacers within said channels; locating a plurality of spaced apart upper supports within upper areas of said channels, the upper supports each including a body portion defining one or more recesses to locate reinforcing material, said upper supports being so located on upper edge surfaces of spaced apart foundation elements, on either side of a channel, such that the body portions thereof are located within upper areas of said channels between spaced apart adjacent sides of foundation elements and above said base spacers and reinforcing located relative thereto; thereafter locating upper reinforcing material relative to said upper spacers, such that upper reinforcing extends over the base spacers and reinforcing, and between foundation elements and thereafter pouring concrete, so as to envelop said foundation elements, said base spacers, said upper supports and said reinforcing.

According to a further aspect of this invention, there is provided a method of forming a building foundation, including locating a plurality of foundation elements on a base surface within an area bounded by formwork, such that the foundation elements are spaced apart one from the other so as to form a plurality of elongate channels therebetween; locating a plurality of spaced apart base reinforcing support/spacers on said base surface and within said channels and between opposing sides of spaced apart adjacent foundation elements; placing elongate reinforcing over/on said base spacers within said channels; locating a plurality of spaced apart upper reinforcing supports within upper areas of said channels, the upper supports each including a body portion defining one or more recesses to locate reinforcing material, said upper supports being so located on upper edge surfaces of spaced apart foundation elements on opposing sides of a channel, such that the body portions thereof are located within upper areas of said channels between spaced adjacent sides of foundation elements and above said base spacers and reinforcing located relative thereto; thereafter locating upper reinforcing material relative to said upper spacers, such that said upper reinforcing material extends over the base spacers and reinforcing, and between foundation elements; and thereafter pouring fiber-reinforced concrete into the area bounded by said formwork, so as to envelop said foundation elements, said base spacers, said upper supports and said reinforcing.

According to a further aspect of this invention, there is provided a spacer/reinforcing support for use in concrete foundation construction where said foundation includes a plurality of elements spaced apart so as to define at least one channel therebetween; said spacer/-reinforcing support including a body having a base portion and an upper cover portion defining one or more recesses to locate reinforcing material and side members which extend outwardly therefrom and relative to said base portion; the arrangement being such that in use said base portion is located in a channel defined between adjacent spaced apart elements; underside surfaces of said side members being seated on upper side edge surfaces of said adjacent, spaced apart elements, such as to position said one or more recesses in position above said channel and said elements.

According to a further aspect of this invention, there is provided a spacer for location between spaced apart foundation elements and/or spaced apart foundation elements and perimeter formwork, in concrete foundation work, including a body portion with elongate stabilising arms extending outwardly from opposing sides at or adjacent at least opposing lower end corners thereof.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE ACCOMPANYING DRAWINGS

This invention will now be described by way of example only and with reference to the accompanying drawings which are given by way of illustration only, and thus are not limitative of the present invention, and, wherein:

FIG. 1 is a plan sectional view of a foundation construction according to one form of the present invention, FIG. 2 is a perspective diagrammatic view of a building foundation construction according to one form of the present invention, FIG. 3 is a diagrammatic end view of a section of a foundation construction according to one form of the present invention, FIG. 4 is a diagrammatic/perspective view of a building foundation construction according to one form of the present invention, FIG. 5 is a perspective view of a spacing element according to one form of the present invention, FIG. 6 is a perspective view of a spacing element according to a further form of the present invention, FIG. 7 is a perspective view of an upper support member for use in accordance with one form of the present invention and FIG. 8 is a diagrammatic end view of an upper support such as shown in FIG. 7 of the accompanying drawings located between spaced apart foundation elements according to one form of the present invention.

DETAILED DESCRIPTION OF PREFERRED EMBODIMENTS OF THE PRESENT INVENTION

Figure 1:
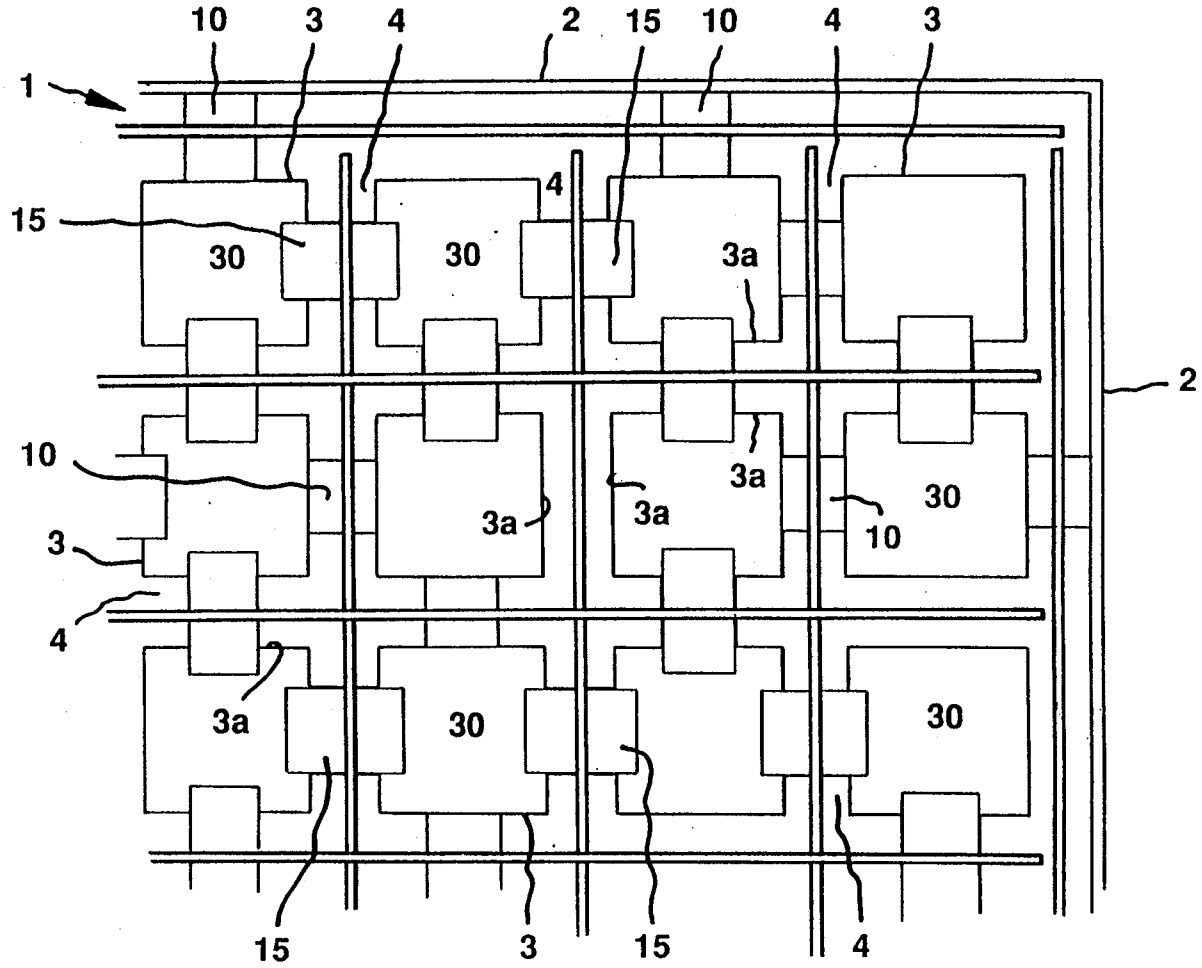

This invention will now be described by way of example only and it should be appreciated that improvements and modifications may be made to the invention without departing from the scope or spirit thereof.

The present invention sets out to overcome or minimise one or more of the problems associated with building foundations and methods of building foundations for building construction, as known and used up until this time; for example, as exemplified by the methods and arrangements disclosed in the prior Australian patent specifications Nos 562334, 584769 and 591816.

In the preferred form of the invention, a foundation construction is formed on a desired area or ground, which is preferably relatively level or flat. The base surface or ground 1 is preferably bounded by appropriate formwork or boxing 2 which defines the predetermined area within which the building foundation is to be formed.

A plurality of foundation elements 3 are provided and are located within the area bounded by the formwork 2 so that the foundation elements 3 are spaced apart one from the other, so as to form a plurality of channels 4 extending therebetween and between the elements 3 and the formwork 2. In one form of the invention as shown in the accompanying drawings, the channels 4 extend substantially at right-angles one to the other. Channels 4 are formed, not only between adjacent elements 3, but between the outer surfaces of the elements 3 and the inner surfaces of the formwork 2.

The elements 3 are constructed of any desired material but are preferably of a foam plastics material which may in one form of the invention be partially hollow or may be solid. While this is desirable from the point of view of providing the most effective method and foundation, elements formed of other material such as cardboard, and elements such as cardboard boxes can be used. Where cardboard boxes are used, the method of the present invention (which does not involve mesh extending over upper surfaces of the elements), overcomes or substantially minimises problems which have been associated with the use of cardboard boxes (with mesh extending thereover) up until this time.

Figure 2:
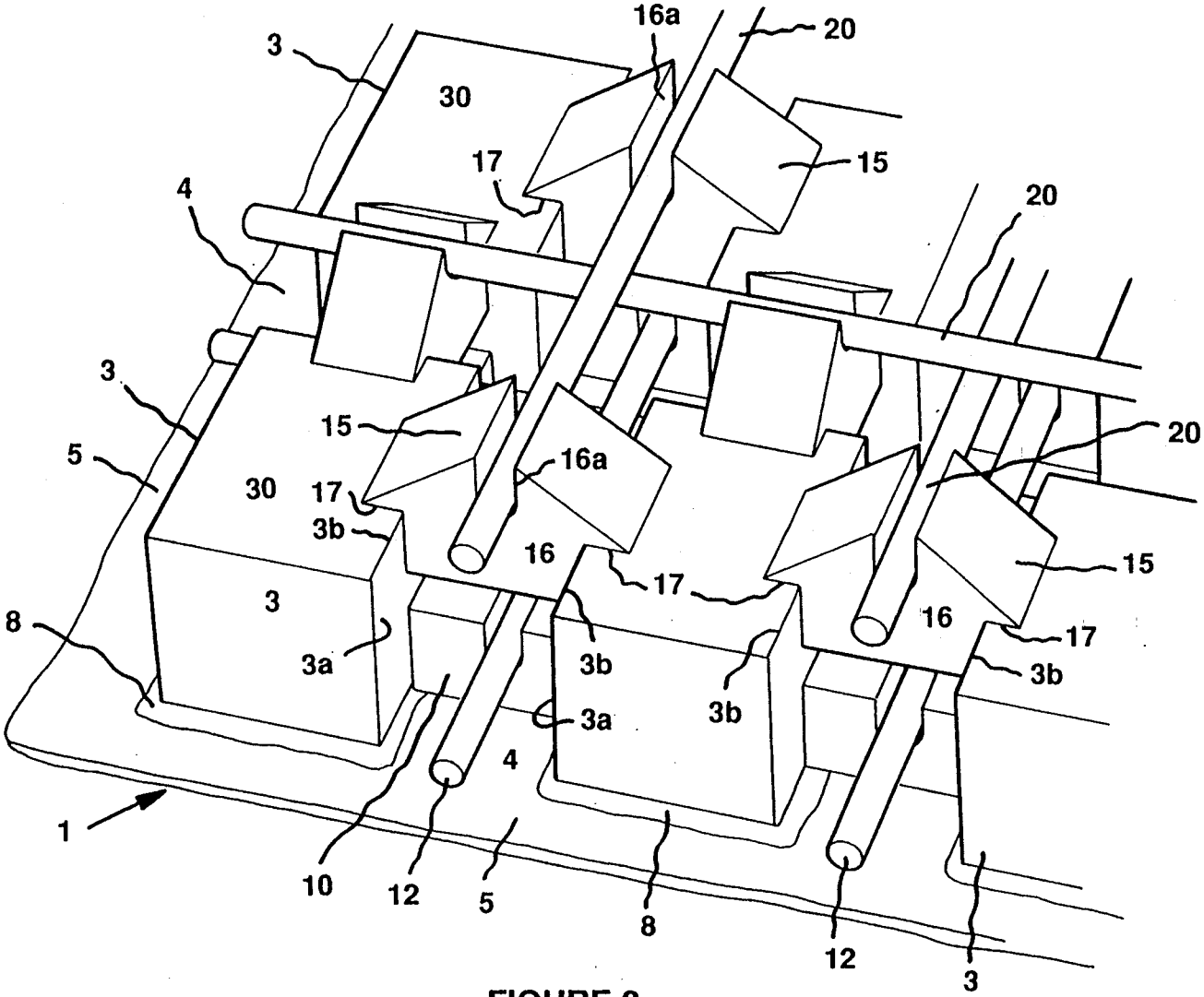
Figure 3:
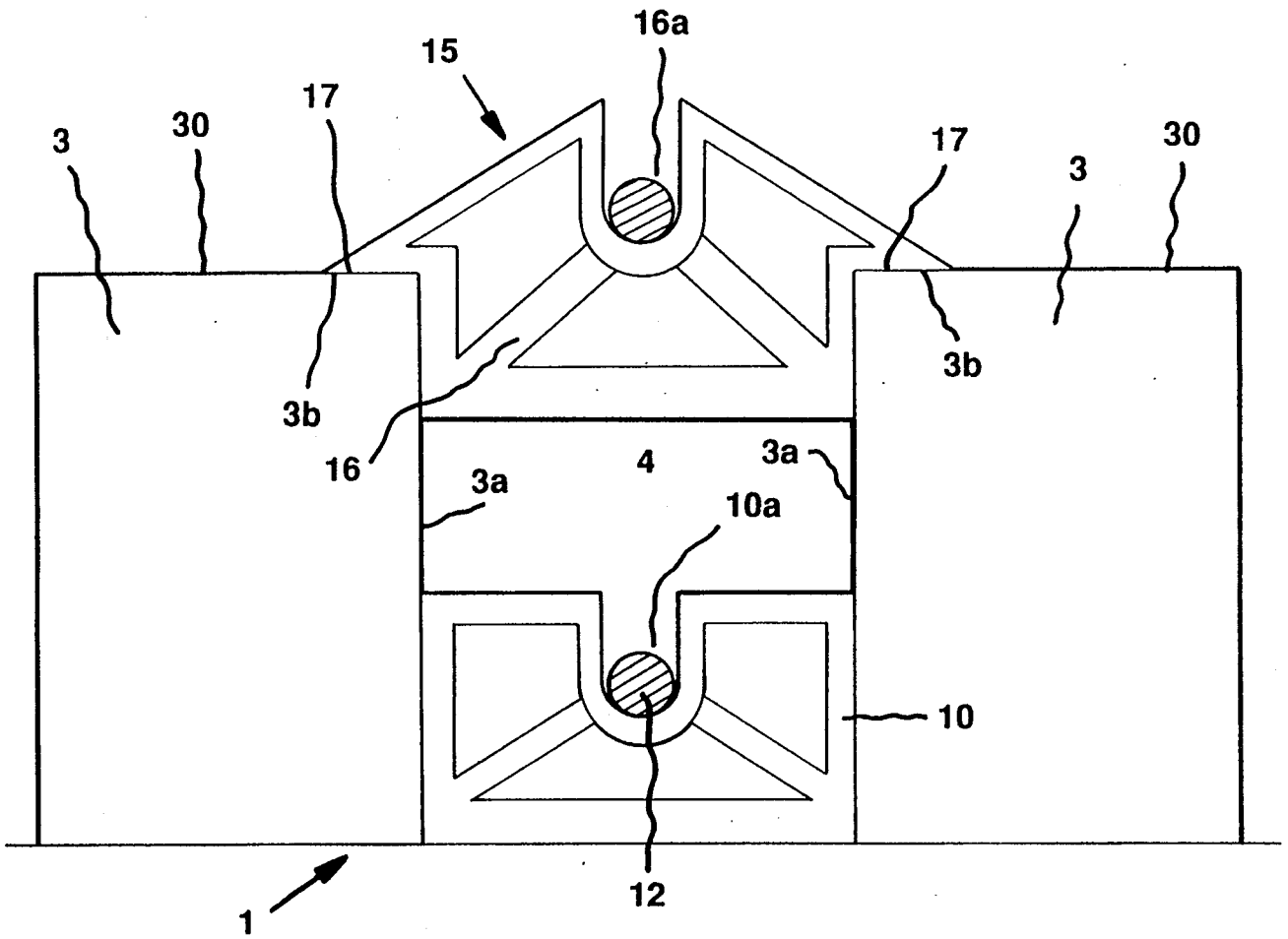
Figure 4:
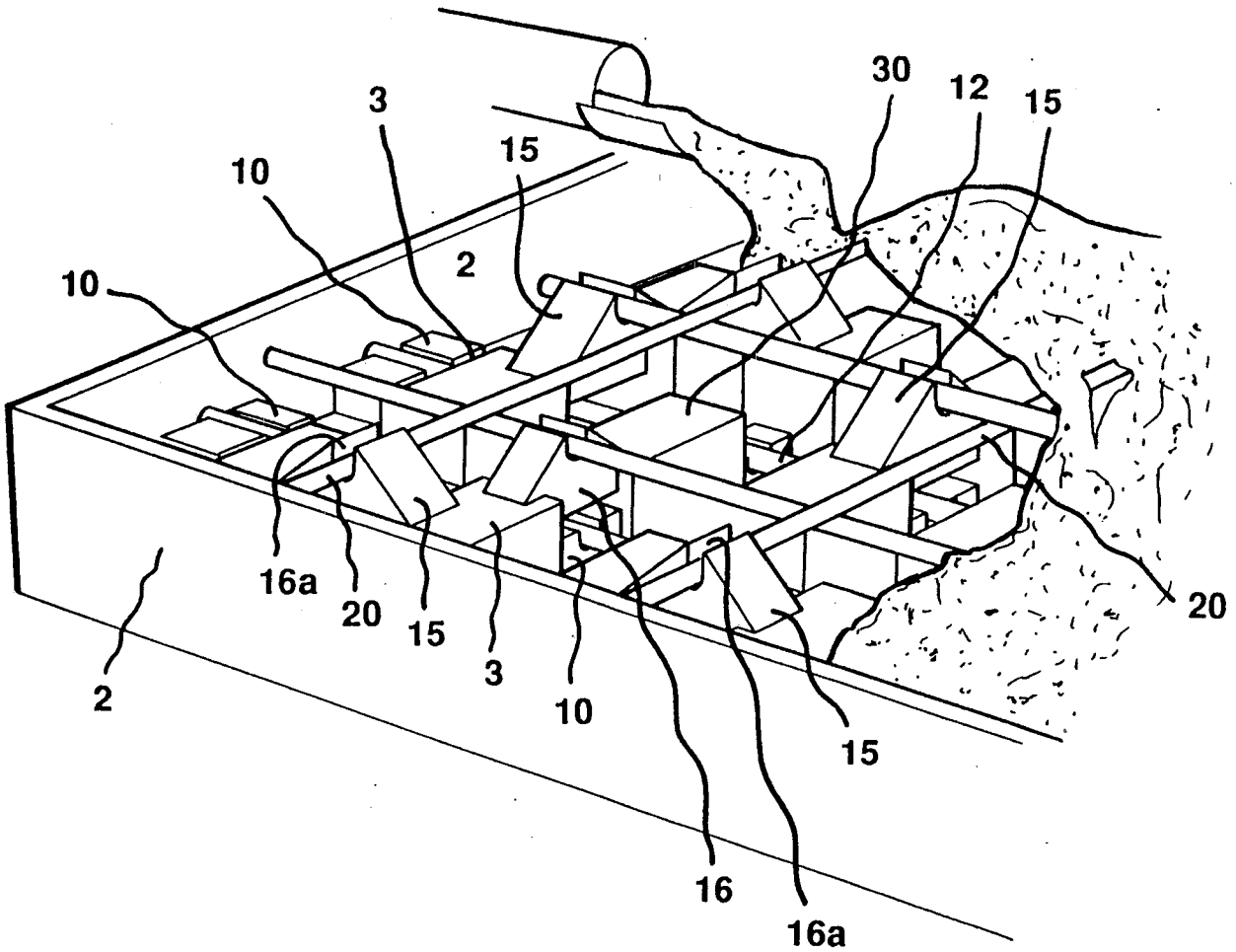

In one form of the invention and as shown by way of example only in FIG. 2 of the accompanying drawings, once the predetermined area within which the foundation is to be constructed has been defined (for example by location of the formwork 2), sheet material 5, such as for example plastic sheet material, can be laid over the base or ground surface. Thereafter, the foundation elements 3 can be placed on the sheet material 5. In certain forms of the invention, and in particular (although not exclusively) where the foundation elements are formed of a plastics material, bonding agents or glue or the like 8 can be used to bond or glue the foundation elements 3 to the sheet material 5 in a spaced apart arrangement so as to form channels 4 therebetween, so that the foundation elements 3 are securely located on the sheet material 5. This will assist in forming the foundation construction and will avoid (if necessary) accidental movement of the elements out of position during preparation of the foundation construction. It will also avoid or minimise foundation elements being moved or blown, such as by wind, which might well be the case if foundation elements were constructed of a hollow configuration or were constructed of a light-weight material. It should be appreciated that while this is an advantageous feature of one form of the invention, it is not essential to the performance of the invention.

Once the foundation elements 3 have been located in position so as to form channels 4 therebetween, base spacers 10 can be located therebetween, in particular between opposing sides 3*a* of adjacent spaced apart foundation elements 3. This is shown by way of example in the accompanying drawings. If desired, base spacers can be located in other positions, relative to the elements.

The base spacers 10 can be of any desired construction or configuration, but in one preferred form of the invention are base spacers substantially as described and claimed in our Australian patent specification No 634950. The disclosure of Australian patent specification No 634950 is incorporated herein by way of reference. Preferably the base spacers 10 are constructed of an appropriate material such as plastics material and are adapted to sit on the base surface so as to extend between the foundation elements and are also formed with one or more recesses to allow for reinforcing material, such as rods of metal reinforcing material, to extend therethrough and between as spaced apart base spacers.

It should be appreciated however that other forms of base spacers and base spacers formed of other materials can be used.

In a preferred form of the invention, a plurality of spaced apart base spacers 10 are located within the channels 4 and preferably between spaced apart sides 3*a*, of spaced apart adjacent foundation elements 3 (and also between elements 3 and formwork 2), the base spacers 10 being longitudinally spaced apart one from the other along the channels 4 which, as will be appreciated from the accompanying drawings, can extend substantially at right angles to, or transverse relative to, each other.

Lower reinforcing material, such as rods of reinforcing metal 12, are then located on the base spacers 10, for example within recesses or grooves 10a provided therein and are thus located in position adjacent the base surface 1. This then locates lower reinforcing material 12 in position.

While the present invention is described by way of example only with reference to base spacers 10 extending between opposing sides of spaced apart elements, forming channels therebetween and such as for example described and claimed in our Australian patent specification No 634950, it should be appreciated that the foundation arrangement and method of the present invention have equal application to using other forms of base spacers, such as corner spacers and the like, as are generally disclosed in Australian patent specifications Nos 562334, 584769 and 591816.

Once the base spacers 10 and lower reinforcing material 12 are in position, a plurality of upper supports 15 are taken and are located in position between the foundation elements 3. In one form of the invention the upper supports 15 are in the form of upper supports such as described and claimed in our Australian patent specification No 634949, the disclosure of which is incorporated hereinto by way of reference. It should be appreciated however that other forms of upper support can be used.

It is important however for the present invention that the upper supports 15 be provided with a central body portion 16 and one or more recesses 16*a* for locating reinforcing material, and are also provided with means such as for example outwardly extending side portions 17, which engage with outer side edges 3*b* of the upper surfaces 30 of the foundation elements 3 so that a lower central body portion 16 is in essence located within a channel portion 4 or an upper area of the channel 4 portion as defined by spaced apart foundation elements 3. In the preferred form of the invention the outwardly extending side portions 17 of the upper supports sit or rest on, or are engaged with, upper side edge portions 3*b* of the foundation elements 3 so that the body portion 16 extends between the spaced apart foundation elements 3 and within the channel 4 therebetween, so that means 16*a* for receiving and housing elongate reinforcing material 20 are located generally within the channel area or in an upper portion thereof (between the foundation elements) and spaced apart above the lower base spacers 10 and lower reinforcing material 12. If desired, securing means such as spikes can be provided in association with side portions 17 of the upper supports 15, to engage within upper side edge surfaces of the foundation elements 3 to hold the upper supports 15 in position between the foundation elements 3.

In use therefore, and as shown in the accompanying drawings, a plurality of spaced apart upper supports 15 are located along upper areas of the channels 4, longitudinally spaced apart one from the other, and one or more rods of reinforcing material 20, such as metal reinforcing material, are located therein or relative thereto, so that the upper reinforcing material 20 extends essentially above the lower reinforcing material 12 and above the area of the channels 4, and does not at any stage form a mesh extending across the upper surfaces 30 of the foundation elements 3. This then saves reinforcing material and also avoids the need for the placement of supports on top of the foundation elements 3 and the need to support the upper mesh on the top of foundation elements 3 as has been the case up until this time. This has been found to have substantial advantages relative to known arrangements.

Once the foundation elements and reinforcing are in position within the area bounded by the formwork 2, concrete is then poured over the foundation elements 3, the base spacers 10, the upper supports 15 and the lower and upper reinforcing material 12, 20, so that they are enveloped by concrete, preferably within the area bounded by the formwork. This is then allowed to cure and a particularly effective reinforced foundation construction results.

While it is clearly advantageous to use outer formwork, this is not essential. Other outer surrounds or the like (such as a formed recess) could be used.

In the preferred form of the invention, the concrete is fibre-reinforced concrete. As referred to hereinbefore, one of the advantages of the present invention is that it avoids the need to provide a mesh of reinforcing material extending over the upper surfaces 30 of the foundation elements 3. As discussed, there are substantial disadvantages with methods employing the location of such a mesh. It is difficult to locate, results in problems associated with the foundation elements and is particularly expensive from the point of view of using substantive amounts of rods of reinforcing material. The present invention has been found to provide an equally strong foundation constructions without utilising an upper mesh of reinforcing material extending over the foundation elements 3, in that the lower and upper reinforcing 12, 20 extending within, and relative to, the channels 4 between the foundation elements 3 (but not extending over the upper surfaces 30 of the foundation elements), adds sufficient strength and is satisfactory as to meet the necessary building regulations and requirements. Particularly this is the case where fiber-reinforced concrete is provided and poured over the elements 3, spacers 10, supports 15 and reinforcing material 12, 20. The fiber-reinforced concrete then combines with these components to cure and provide a strong and reinforced foundation construction.

In the preferred forms of the invention described with reference to FIGS. 1 through 4 of the accompanying drawings, reference is made to base spacers 10 and upper supports 15. Preferred forms of these spacers 10 and supports 15 will now be described with reference in particular to FIGS. 5, 6, 7 and 8 of the accompanying drawings.

Figure 5:
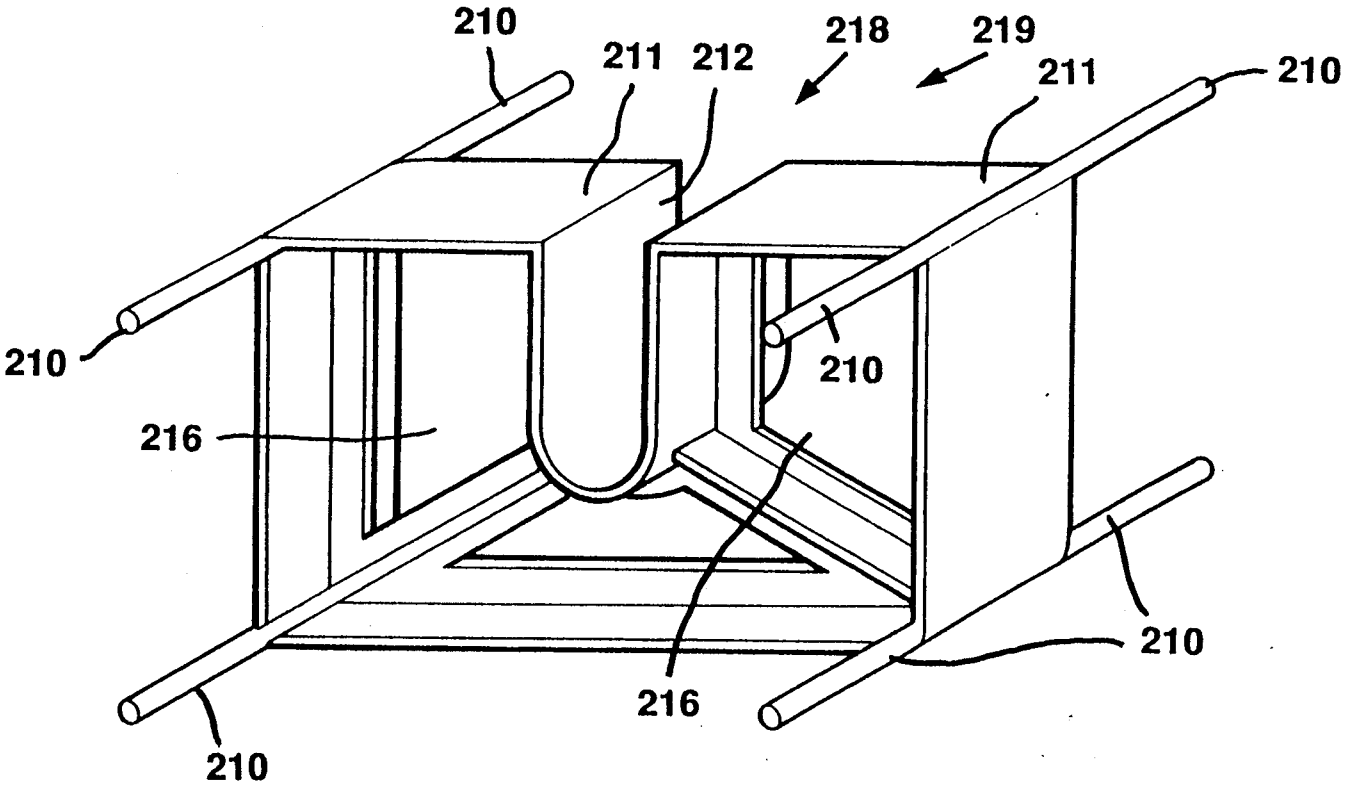
Figure 6:
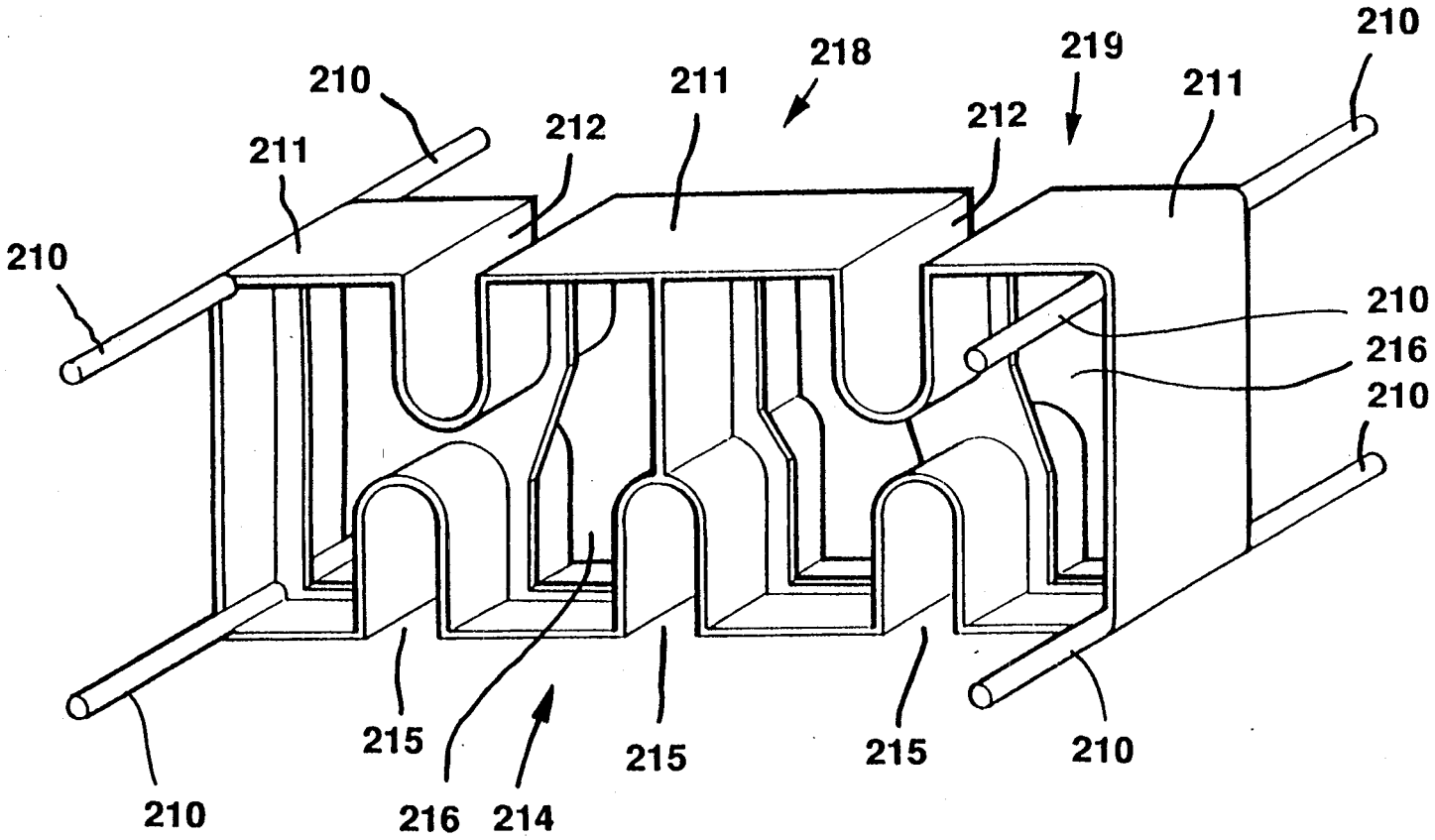

Referring firstly to FIGS. 5 and 6 of the accompanying drawings, two forms of spacer 218 are shown which include a body portion 219 formed of an appropriate material such as for example a moulded plastic material. This is however by way of example only and other materials may be used. The body 219 is substantially elongate in formation and at least partially hollow so that concrete can pass therethrough and securely bind and engage therewith.

Referring to FIG. 5 of the accompanying drawings, the upper surface 211 of the spacer is preferably provided with a recess 212 into which one or more lengths of reinforcing material can be located. In use, a plurality of such spacers 218 are spaced apart one from the other, such as along a channel between spaced apart adjacent foundation elements 3 (with reference to FIGS. 1 through 4 of the drawings) so that elongate metal reinforcing material and the like will pass through and be supported by the recesses 212 in substantially aligned and spaced apart spacers 218.

Referring again to FIG. 5 of the accompanying drawings, the spacer 218 is provided with stabilising supports 210. The stabilising supports preferably take the form of outwardly extending arms 210, provided at or adjacent the top and bottom of opposing sides, at each end of the spacer 218. The arms 210 in the preferred form of the invention extend outwardly from the body 219 of the spacer 218, substantially transverse relative to the longitudinal axis of the body 219 of the spacer. Preferably, the arms 210 extend out from at least the base of the spacer 218. In use, the spacer 218 is inserted into a channel between opposing sides of foundation elements 3 (as shown in FIGS. 1 and 2 of the drawings). The arms 210 forming the stabilising supports thereby abut against adjacent but spaced apart sides of opposing and spaced apart foundation elements 3. Further, the stabilising arms 210 at least on the base sit on a surface within for example formwork, or on sheet materials and thus support and stabilise the spacer 218. It should be appreciated that when concrete is poured, such as within the channels and over the spacers 218, it is possible for the spacers 218 to be knocked over or to become dislodged, thus detracting from the efficient pouring of the material and detracting from the secure location of spacers and reinforcing material. Thus, the reinforcing support arms 210 at least on the base of each end of the spacer 218 hold the spacer in position. While the spacer arms 210 are described by way of example as being located at each end of the body 219, they could be positioned or provided intermediate the ends thereof, should this be desired.

It should be noted from FIG. 5 of the drawings, that in the preferred form of the invention, support arms 210 also extend outwardly from upper ends of opposing sides at each end of the spacer 218. These are not essential but are preferred in that they allow for the concrete to bind about the spacer to a further extent and also allow for the spacer to be secured in position against opposing sides of foundation elements 3, between which the spacer 218 is located.

The use of the stabilising support arms 210 has been found to contribute substantially to the efficiency of the present invention.

Referring now to FIG. 6 of the accompanying drawings, this also shows a spacer element 218 which is substantially elongate in formation and which is provided with a plurality of recesses 212 in an upper surface 211 thereof, and a plurality of recesses 215 on a lower surface 214 thereof. In one form of the invention, the spacer 218 is used in channels between inner surfaces of formwork and outer surfaces of foundation elements 3. In other forms of the invention, one or more spacers 218 is/are used between spaced apart adjacent foundation elements 3.

In one preferred form of the invention, the upper surface 211 is provided with two laterally spaced apart recesses 212 to locate and house spaced apart lengths of elongate reinforcing material, while the lower surface 214 is provided with for example three laterally spaced apart recesses 215. Ends of the spacers 218 are also provided with upper and/or lower outwardly extending support arms 210.

The body 219 of the spacers 218 of FIGS. 5 and 6 of the drawings is provided with substantially hollow voids 216 and lower recesses 215, to enable concrete to pass therethrough and so as to bind about the spacers.

When the spacers 218 shown in FIG. 6 of the drawings are used in a form with two laterally spaced apart recesses 212 uppermost, the spacers are able to locate two lengths of elongate reinforcing material, laterally spaced apart one from the other. In such a position, the three laterally spaced apart recesses 215 are adjacent the base surface within formwork or on sheet material. On concrete being poured, concrete will pass through these recesses. If however it is desired to have a greater number of recesses on an upper surface of a spacer 218 (such as to locate a greater number of lengths of reinforcing material), a spacer such as shown in FIG. 6 of the drawings can be turned over so that for example three spaced apart recesses 215 are uppermost and two spaced apart recesses 212 are lowermost.

The invention is described by way of example only and with reference to one surface having two spaced apart recesses and the other surface having three spaced apart recesses. These numbers can vary. For example, one surface could have one recess and another surface two or three recesses. The variations are infinite.

Figure 7:
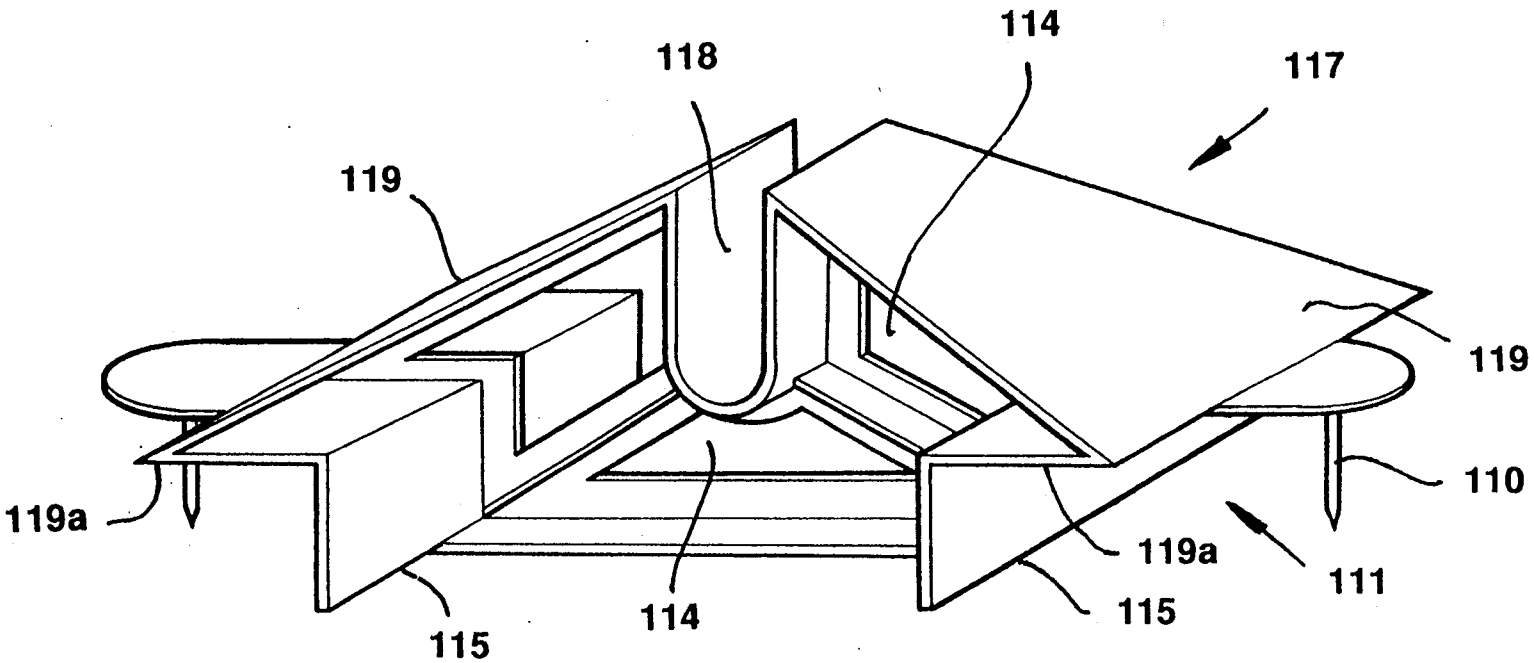
Figure 8:
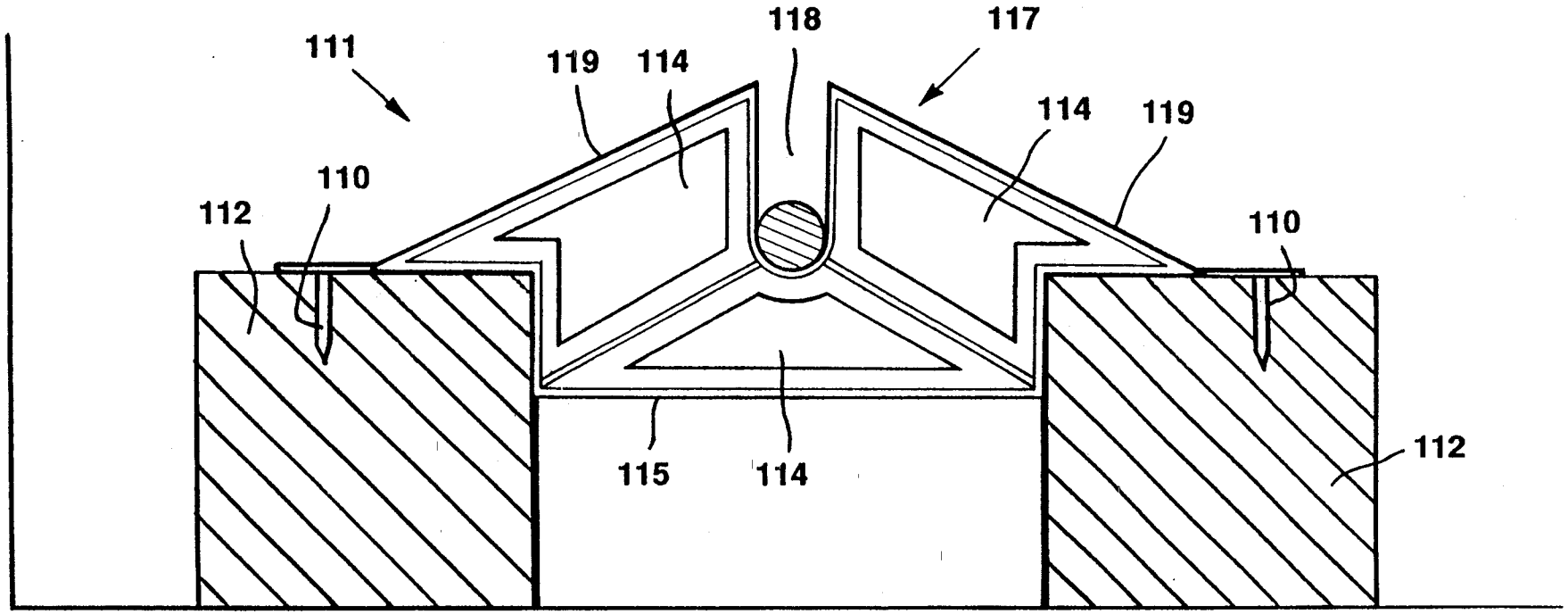

Referring now to FIGS. 7 and 8 of the accompanying drawings, these illustrate one preferred form of an upper reinforcing support 15 as described with reference to FIGS. 1 through 4 of the accompanying drawings.

The support 111 shown in FIGS. 7 and 8 of the accompanying drawings is preferably formed of an appropriate plastic material although this is by way of example only. Other materials can be used if desired. The spacer 111 is preferably formed with voids or hollows 114 therein, through which concrete can pass so as to securely engage and bond with and about the spacer 111 (and any reinforcing material it supports).

The spacer 111 preferably has a base or body portion 115 of a width appropriate to placed within a channel formed between spaced apart foundation elements 3 (as for example described with reference to FIGS. 1 and 2 of the accompanying drawings).

The spacer support 111 also has an upper cover portion 117 which defines a substantially central recess 118 which is a reinforcing support recess. If desired, other forms of reinforcing support recess can be provided or a plurality thereof can be provided. In use, a plurality of upper supports 111 will be positioned so as to be preferably spaced apart along channels formed between foundation elements, and the recesses 118 of the supports 111 will be substantially aligned, so that reinforcing material can extend through such substantially aligned recesses 118.

Referring further to FIGS. 7 and 8 of the accompanying drawings, the cover portion 117 extends into two outwardly extending and angled side members 119, which extend outwardly from the recess to each side of and above the base or body portion 115. The angled side members 119 of the cover 117 have substantially flat or planar undersides **119*a* which extend outwardly for example at substantially right angles to the vertical axes of the sides of the base or body 115**.

In one preferred form of the invention, the underside surfaces **119*a* of the side members 119 are provided with one or more downwardly depending engagement spikes 110**.

In one preferred form of the invention as shown in FIG. 8 of the accompanying drawings, the base or body portion 115 is located within a channel between spaced apart foundation elements 112. The underside portions **119*a* of the sides 119 then come into contact with upper surfaces of the elements 112. Where the elements are, in one preferred form of the invention, formed of a foam plastics material, the securing spikes 110 engage therewithin so as to bring the undersides 119*a* into substantial abutment with upper side edge surfaces of the elements 112. This allows for the location of the base 115 within the channel, with the spikes 110 being located in upper side surfaces of the elements 112. This will hold the spacer/support 111 securely in position in which it rests on the side edge surfaces of the elements 112, with the base 115 located in the channel between the spaced apart elements 112. This also locates the recess 118 above and in substantial alignment with the channel and preferably above upper surfaces of the elements 112 but not extending across upper surfaces of the elements 112**.

In one form of the invention (not shown in the accompanying drawings), the spacer 111 of the present invention can be formed without securing spikes 110, so that the spacers 111 will be located in position by the base or body portions 115 being located within channels between spaced apart foundation elements, with the undersides **119*a* thereof merely resting on upper side edge surfaces of the spaced apart foundation elements 112** on each side of the channel.

In a further form of the invention and as shown in particular with reference to FIG. 7 of the accompanying drawings, the spacer support 111 is provided with lugs or flaps which extend outwardly from the sides 119 and substantially parallel and substantially co-planar with the underside portions **119*a*. These extension flaps or lugs can for example be provided substantially intermediate of the sides 119 and can be substantial extensions of (and integrally formed with) the undersides 119*a* of the sides. In preferred forms of the invention, the securing means or spikes 110** can extend downwardly from an underside of these extension lugs.

It will be appreciated that there are substantial advantages with using the spikes 110 in the present invention, in particular in association with foundation elements constructed of a foam plastics material. It is however envisaged that the invention would have equal application to foundation elements and hollow elements formed of other materials such as cardboard elements and the like. The spikes 110 secure the sides of the upper supports 111 to the upper side edges of the foundation elements on either side of a channel so that the body portions 115 are securely located within the channels and the reinforcing support recesses 118 located above the channels. This allows for the location of reinforcing material above lower reinforcing material and avoids the need for reinforcing to cross over upper surfaces of foundation elements.

The spacers and supports described with reference to the accompanying drawings and by way of example only can be constructed of any appropriate material.

The present invention has been described by way of example only and with reference to the accompanying drawings, and it should be appreciated that modifications and improvements may be made thereto without departing from the scope thereof, as defined by the appended claims.

I claim:

1. A building foundation including a plurality of foundation elements located on a base surface and spaced apart one from the other within a predetermined area, such as to form a plurality of elongated channels extending therebetween; a plurality of base reinforcing support spacers being located on said base surface and within said channels between adjacent elements; base reinforcing material being located on and extending between said base reinforcing support spacers within said channels; a plurality of upper reinforcing supports being provided and each having a body portion and an upper cover portion defining at least one recess to locate upper reinforcing material; side members extending outwardly from the cover portion relative to the body portion; at least one securing member extending downwardly from an underside of each side member; each upper reinforcing support being supported on and extending between upper side edge surfaces of spaced apart adjacent elements so that the body portion of each upper reinforcing support is located within an upper area of a channel, with underside surfaces of said side members and said securing members extending downwardly therefrom, being engaged with upper side edge surfaces of said spaced apart adjacent elements on either side of said channel; upper reinforcing material being located in said at least one recess of said body portion and extending between spaced apart upper reinforcing supports so as to extend over and above said base reinforcing material, within an area defined by sides of said channels, but not so as to extend over upper surfaces of said foundation elements; and fiber reinforced concrete poured within said predetermined area, so as to envelop said foundation elements, said base spacers and said upper supports, and said reinforcing material.

2. The building foundation as claimed in claim 1, further comprising sheet material extending over said base surface within an area bounded by outer formwork; said foundation elements being one of bonded and glued to said sheet material, so as to be spaced apart from one another and so as to form said plurality of channels therebetween.

3. The building foundation as claimed in claim 1, wherein said foundation elements are in the form of blocks of foam plastics material.

4. The building foundation as claimed in claim 1, wherein the side members extending outwardly from the cover portion of each upper reinforcing support are provided with outwardly extending extension lugs; at least one securing member extending downwardly from an underside of each extension lug; the arrangement being such that the body portion of each upper reinforcing support, is located in a channel between adjacent spaced apart foundation elements, with underside surfaces of said side members and said extension lugs, together with said securing members, being seated on and engaging with upper side edge surfaces of adjacent spaced apart foundation elements on either side of a channel.

5. The building foundation as claimed in claim 1, wherein said base reinforcing support spacers each include a body portion with elongate stabilizing arms extending outwardly from opposing sides thereof.

6. The building foundation as claimed in claim 1, wherein said base reinforcing support spacers each include a body portion provided with at least one recess to locate and to support said reinforcing material.

7. A method of forming a building foundation including:

locating a plurality of foundation elements on a base surface, within a predetermined area, such that said foundation elements are spaced apart one from the other so as to form a plurality of elongated channels therebetween;

locating a plurality of base reinforcing spacers on said base surface and within said channels between adjacent foundation elements, and placing elongated reinforcing material on and between said base spacers within said channels;

locating a plurality of spaced apart upper reinforcing supports within upper areas of said channels;

the upper supports each including a body portion and an upper cover position defining at least one recess to locate reinforcing material, the side members extending outwardly from the cover portion and relative to the body portion, at least one securing member extending downwardly from an underside of each side member;

said upper supports being located in position within said channels, such that the body portions thereof are located in said channels between adjacent spaced apart foundation elements, with underside surfaces of said side members and said securing members extending downwardly therefrom, being engaged with upper side edge surfaces of adjacent spaced apart foundation elements on either side of said channels;

locating upper reinforcing material within said at least one recess of said upper spacers such that upper reinforcing material extends over and above the base spacers and base reinforcing material, but between said foundation elements and without extending over upper surfaces of said foundation elements; and thereafter pouring fiber reinforced concrete within said predetermined area, so as to envelop said foundation elements, said base spacers, said upper supports and said reinforcing material.

8. The method as claimed in claim 7, further comprising the steps of placing sheet material on said base surface, and then one of bonding and gluing said foundation elements to said sheet materials so as to be maintained in a position spaced apart one from the other, and so as to define a plurality of channels therebetween.

9. The method as claimed in claim 7, wherein said foundation elements are formed of a foamed plastics material.

* * * * *

UNITED STATES PATENT AND TRADEMARK OFFICE

CERTIFICATE OF CORRECTION

PATENT NO. : 5,421,136

DATED : June 6, 1995

INVENTOR(S) : Christopher VAN DE PEER

It is certified that error appears in the above-identified patent and that said Letters Patent is hereby corrected as shown below:

Column 12,

In claim 7, line 16, please change "position" to --portion--

Signed and Sealed this

Thirtieth Day of April, 1996

*Attest:*

*Attesting Officer*

BRUCE LEHMAN

*Commissioner of Patents and Trademarks*